United States Patent [19]

Williams et al.

[11] Patent Number: 4,581,916

[45] Date of Patent: Apr. 15, 1986

[54] PRESS ROLLER TRANSFER SYSTEM

[75] Inventors: Brian D. Williams; Bernard C. Gillitzer, both of Bettendorf; Charles L. Prosise, Davenport, all of Iowa; Larry E. Nourse, Rock Island, Ill.

[73] Assignee: Deere & Company, Moline, Ill.

[21] Appl. No.: 656,630

[22] Filed: Oct. 1, 1984

[51] Int. Cl.[4] ..... B21J 13/00

[52] U.S. Cl. ..... 72/446; 72/481; 100/918; 308/3 A

[58] Field of Search ..... 72/446, 448, 419, 420, 72/481, 482; 100/295, 918; 308/3 A, 3 B, 6 R

[56] References Cited

U.S. PATENT DOCUMENTS

| | | | |
|---|---|---|---|
| 3,455,141 | 7/1969 | Bracco et al. | 72/446 |
| 4,301,673 | 11/1981 | Yonezawa | 100/918 |
| 4,459,909 | 7/1984 | Takagi | 72/448 |

FOREIGN PATENT DOCUMENTS

| | | | |
|---|---|---|---|
| 111528 | 9/1981 | Japan | 72/446 |
| 990547 | 1/1979 | U.S.S.R. | 72/446 |

*Primary Examiner*—Francis S. Husar
*Assistant Examiner*—David B. Jones

[57] ABSTRACT

A press table including a plurality of formed wells and canals. A plurality of cylinders received in said well supporting a frame structure comprised of a plurality of channel member positions to be received in said canals. A plurality of rollers are fixably and independently mounted in each of said channel members.

2 Claims, 4 Drawing Figures

PRESS ROLLER TRANSFER SYSTEM

BACKGROUND OF THE INVENTION

This invention relates to means for positioning a die on a press table and more particularly, to a die table roller transfer system.

A die is used by a press to press form sheet metal parts. In some pressing operations, dies of excessive weight are employed which can present a problem in manipulating the die on the press table to assume the proper alignment. It is known to use a roller transfer system to facilitate positioning of the die on the press table. One such roller transfer system includes a plurality of roller blocks. Each roller block has a plurality of rollers embedded within the block. The blocks can be slidably positioned in T-solts formed in the press table. By introducing pressurized fluid to the blocks, the rollers elevate within the blocks allowing a die to be positioned on the rollers and easily manipulated to assume the correct press alignment. By relieving the pressurized fluid, the rollers then descend allowing the die to rest upon the press table. Should a roller block malfunction, e.g., due to the development of a leak, the roller block must be removed for repair.

Another roller transfer system utilizes a roller block having independently mounted rollers biased in an elevated position by a respective spring. The spring force provided must be sufficient to support a die of prescribed weight, requiring clamping of the die to the press table when in position. Such transfer systems offer the benefit of being able to remove a singular roller for repair.

SUMMARY OF THE INVENTION

It is an objective of the present invention to present a roller transfer system for mounting on the press table of a press machine which provides independent and cooperative operation of the associated rollers.

It is a further objective of the present invention to present a roller transfer system which is easily repaired.

A press table is modified to include a plurality of wells which receive a respective hydraulic or pneumatic cylinder. The press table is further modified to allow the introduction of feed lines to the respective cylinder. Fixably mounted to the hydraulic cylinders is a frame structure which, in the down position, is received within mating canals formed in the press table. The frame structure is comprised of a plurality of channel members having located therein a plurality of independently mounted rollers. Activation of the cylinders raises the frame structure to allow a die to be supported on the rollers. Deactivation of the cylinders lowers the die onto the press table.

DESCRIPTION OF THE PREFERRED EMBODIMENT

Figure 1:
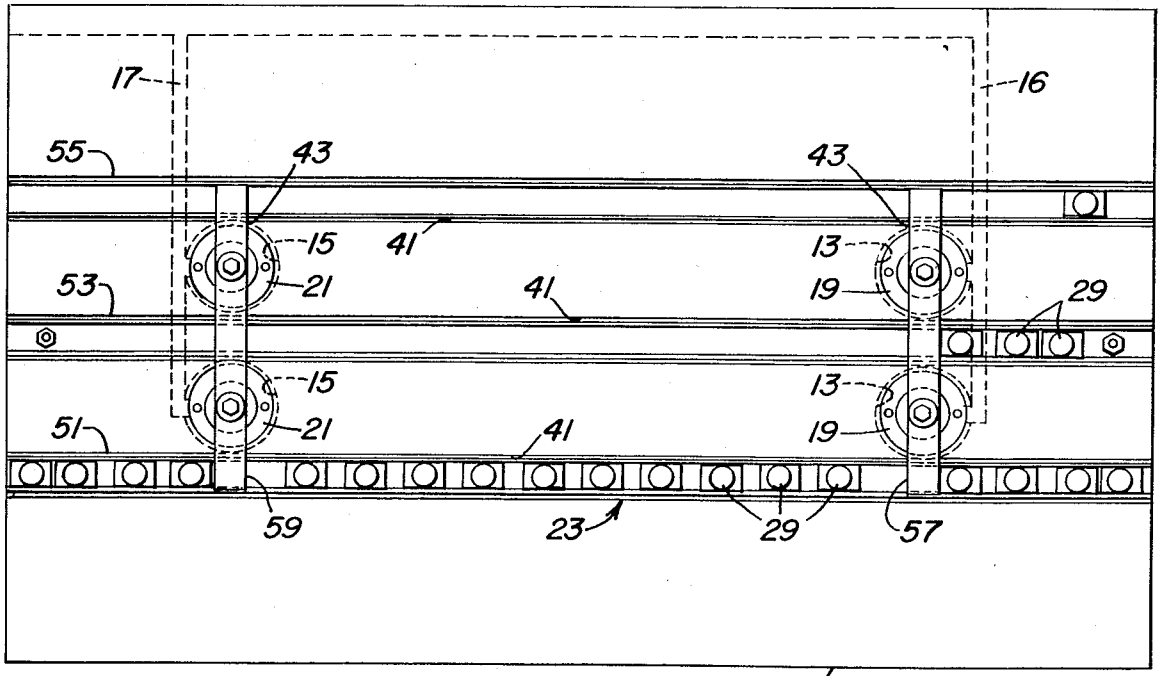
FIG. 1 is a top view of a press table including a roller transfer system in accordance with the present invention.
Figure 2:
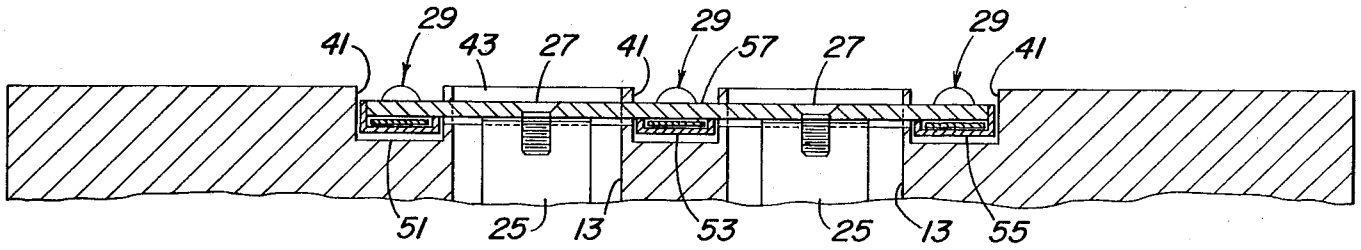
FIG. 2 is a sectional side view of the press table and roller transfer system.

Referring to FIGS. 1 and 2, a conventional press machine (not shown) includes a modified press table 11 having a plurlity of formed wells 13 and 15, and a plurality of formed feed channels 16 and 17 providing access to respective wells 13 and 15. Each well 13 and 15 receives a respective cylinder 19 and 21; in the preferred embodiment the cylinders 19 and 21 are hydraulic. A frame 23 is fixably mounted to the cylinder arm 25 of the respective cylinders 19 and 21 by any conventional means such as by cap screws 27. The frame 23 has fixably mounted thereto, a plurality of rollers 29. The frame 23 and rollers 29 will be more fully described subsequently.

Figure 3:
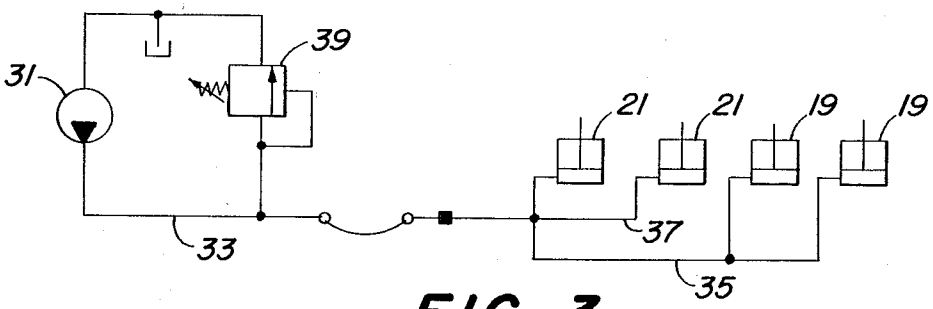
FIG. 3 is a schematic view of a hydraulic circuit in accordance with the present invention.

Referring to FIG. 3, a fixed displacement pump 31 delivers hydraulic fluid to a line 33. Line 33 conducts fluid to lines 35 and 37 which lines conduct fluid to respective cylinders 19 and 21. Lines 35 and 37 journey through respective feed channels 16 and 17 to respective cylinders 19 and 21.

Referring to FIGS. 1 and 3, in operation, pressurized hydraulic fluid is provided by pump 31 to line 33 which conducts fluid to lines 35 and 37 and, therefrom to respective cylinders 19 and 21. The cylinders 19 and 21 in response to the delivered fluid elevate frame 23 from mating sized and configured canals 41 and 43 formed in press table 11. A die (not shown) can then be placed on the rollrs 29 supported by frame 23 allowing the die to be easily manipulated into position. A variable relief valve 39 regulates the pressure in line 33 in a conventional manner. By deactivating pump 31, fluid from line 33 is permitted to bleed from line 33 through pump 31 to sump resulting in cylinders 19 and 21 lowering the frame 23 into canals 41 and 43 and, in so doing, bring the die to rest on the die table 11. The frame 23 is comprised of a plurality of parallel aligned channel members 51, 53 and 55 and cross channel members 57 and 59. The cross channel members 57 and 59 extend transverse to and are fixably mounted to each channel member 51, 53 and 55 by any conventional means such as welding. Cross channel member 57 is fixably mounted to cylinder arm 25 of respective cylinders 19 by cap screw 27 and in like manner cross channel member 59 is fixably mounted to the cylinder arm of respective cylinders 21.

Figure 4:
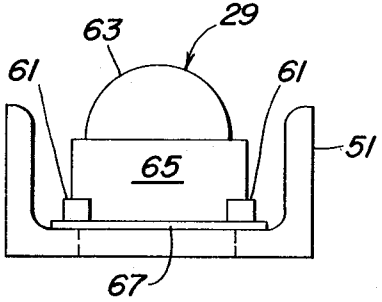
FIG. 4 is an end view of a channel member portion of of the roller transfer system frame.

Referring more particularly to FIGS. 2 and 4, each channel members 51, 53 and 55 has a plurality of rollers 29 fixably mounted therein by conventional means such as cap screw 61. The rollers 27 are of conventional design comprised of a ball 63 mounted in a base 65 which includes a mounting flange 67 through which cap screws 61 are journeyed to be secured in the respective channel member. The rollers 29 are relatively inexpensive to replace and exhibit a high degree of durability. It is observed that the relative height of the rollers 29 is in excess of the height of channel members 41 such that when the frame 23 is in the raised position, the die is supported by rollers 29. Should it become necessary to replace one or more of the rollers, it is only necessary to remove cap screws 61.

We claim:

1. A roller transfer system for mounting to a press table of a press machine to support a die in a first mode and allow said die to be supported on said press table in a second mode, comprising:

said press table having a plurality of formed wells and canals, said canals having a generally U-shaped configuration orientated in said press table such that a first group extends generally parallel in one direction on said press table, and a second group of said canals extends generally parallel and traversing to said first group of canals such that a respective canal of said second group intersects each of said canals of said first group, said wells formed in said table such that at least one of said wells intersects a respective one of said canals of said second group;

a plurality of fluid responsive cylinders each seated in a respective one of said wells and each of said cylinders including a cylinder arm directed outwardly from said respective well;

a frame size and shaped to be matingly received in said canals and fixably mounted to said cylinder arms of the respective cylinders said frame including a plurality of first members matingly received in a respective one of said canals of said first group and a second member matingly received in a respective of said canals of said second group, said second members being fixably mounted to intersecting first members and being fixably mounted to at least one of said cylinder arms;

a plurality of independently mounted rollers fixably and detachably mounted to said first members of said frame such that said rollers vertically extend above said frame; and, fluid means for delivering pressurized fluid to said cylinder causing said cylinders to elevated said frame in a first mode vertically above said press table surface and receiving fluid from said cylinders causing said frame to descened into said canals in said second mode below said press table surface.

2. A roller transfer system as claimed in claims 1 wherein said fluid means comprises a pump, a first line receiving fluid from said pump when activated, second and third lines receiving fluid from said first line, said press table further having a plurality of feed channels such that said second and third lines extend through said feed channel to respective cylinders, and a pressure regulating valve interrupting said first line, wherein deactivation of said pump allows fluid to drain through said pump.

* * * * *